US005342124A

United States Patent [19]

Swisher, Jr.

[11] Patent Number: 5,342,124

[45] Date of Patent: Aug. 30, 1994

[54] MIXER HAVING BLADES ARRANGED IN A DISCONTINUOUS HELICAL PATTERN

[75] Inventor: George W. Swisher, Jr., Oklahoma City, Okla.

[73] Assignee: CMI Corporation, Oklahoma City, Okla.

[21] Appl. No.: 180,000

[22] Filed: Jan. 11, 1994

Related U.S. Application Data

[63] Continuation of Ser. No. 17,661, Feb. 12, 1993, abandoned.

[51] Int. Cl.[5] ..... B28C 5/16

[52] U.S. Cl. ..... 366/66; 366/168; 366/325

[58] Field of Search ..... 366/26, 27, 35, 38, 366/40, 42, 50, 64, 66, 168, 172, 177, 186, 194–196, 318, 322, 324, 325, 331, 603, 326, 327; 198/662–664, 676, 677

[56] References Cited

U.S. PATENT DOCUMENTS

| | | | |
|---|---|---|---|
| 580,346 | 4/1897 | Michaelsen . | |
| 754,927 | 3/1904 | Kenisell | 366/40 |
| 1,650,592 | 11/1927 | Bickel | 366/42 |
| 2,402,931 | 6/1946 | Thomas | 62/114 |
| 3,130,070 | 4/1964 | Potters et al. | 366/324 X |
| 3,614,262 | 10/1971 | Lutz | 366/195 X |
| 3,734,777 | 5/1973 | Bratschitsch | 366/196 X |
| 4,066,215 | 1/1978 | Pujol | 241/46.11 |
| 4,082,227 | 4/1978 | McGrane et al. | 366/195 X |
| 4,281,934 | 8/1981 | Krause et al. | 366/66 X |
| 4,297,208 | 10/1981 | Christian | 210/94 |
| 4,406,548 | 9/1983 | Haws | 366/64 X |
| 4,438,634 | 3/1984 | Merle et al. | 62/342 X |
| 4,472,093 | 9/1984 | Hamilton | 407/41 |
| 4,480,796 | 11/1984 | Paraskevas | 241/46.11 |
| 4,483,625 | 11/1984 | Fisher | 366/196 X |
| 4,513,917 | 4/1985 | Szkaradek | 241/46.11 |
| 4,551,024 | 11/1985 | Clapp | 366/64 X |
| 4,610,068 | 9/1986 | Schultz | 29/418 |
| 4,694,993 | 9/1987 | Endo et al. | 241/46.11 |
| 4,887,911 | 12/1989 | Miyaji | 366/316 |

FOREIGN PATENT DOCUMENTS

| | | | |
|---|---|---|---|
| 2562393 | 10/1985 | France | 366/603 |
| 55-111332 | 8/1980 | Japan | 366/40 |
| 3108510 | 5/1991 | Japan | 366/38 |
| 747464 | 7/1980 | U.S.S.R. | 366/603 |
| 852580 | 8/1981 | U.S.S.R. | 366/66 |
| 968539 | 9/1964 | United Kingdom | 366/325 |
| 1015085 | 12/1965 | United Kingdom | 366/64 |

*Primary Examiner*—Timothy F. Simone
*Assistant Examiner*—Charles Cooley
*Attorney, Agent, or Firm*—Dunlap, Codding & Lee

[57] ABSTRACT

A mixer having an elongated housing with an upper wall, a curved lower wall, an inlet end and a discharge end. A rotatable shaft within the housing extends from the inlet end to the discharge end of the housing. A plurality of blades are attached to the shaft in a discontinuous helical pattern. An injection tube is located at the inlet end of the housing to spray bituminous liquid into the housing. Recycle aggregate and bituminous liquid are introduced into the inlet end of the housing. Asphalt mix is removed from the discharge end of the housing. Each blade has a curved outer end which is in near contact with the lower wall of the housing as each blade moves through a lower part of its rotation. The upper wall of the housing is spaced a distance from the blades to define an open slinging area between the blades and the housing. The blades both mix and move material from the inlet end to the discharge end of the housing.

20 Claims, 2 Drawing Sheets

MIXER HAVING BLADES ARRANGED IN A DISCONTINUOUS HELICAL PATTERN

This is a continuation of copending application Ser. No. 08/017,661 filed on Feb. 12, 1993, now abandoned.

BACKGROUND OF THE INVENTION

1. Field of the Invention

The present invention relates generally to devices for mixing material, and particularly, but not by way of limitation, to an apparatus for mixing recycle aggregate and bituminous liquid to produce asphalt mix.

2. Description of Related Art

Various devices for mixing aggregate and bituminous liquid to produce asphalt mix are well known in the art. The drum mixer, for example, mixes aggregate and liquid asphalt within a rotary drum. The pugmill utilizes rotating shaft-mounted paddles for mixing material. The conventional mixing auger has both a screw blade to convey material and mixing paddles to mix material.

SUMMARY OF THE INVENTION

The present invention includes an elongated housing with an inlet end and a discharge end, a rotatable shaft extending from between the inlet end and the discharge end of the housing, and a plurality of blades mounted to the shaft in a discontinuous helical pattern. The upper wall of the housing is spaced a distance from the blades to provide an open slinging area. The blades pick up and throw material into the slinging area as the material is carried by the blades from the inlet end to the discharge end of the housing. An injection bar is located near the inlet end of the housing for the introduction of bituminous liquid into the housing.

One object of the present invention is to provide a mixer which thoroughly mixes cold recycle aggregate and bituminous liquid in a small area and with a short travel distance of the aggregate.

Another object of the present invention is to provide a mixer which is portable and may be operated with a milling machine for in-place recycling of the asphalt removed by the milling machine.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
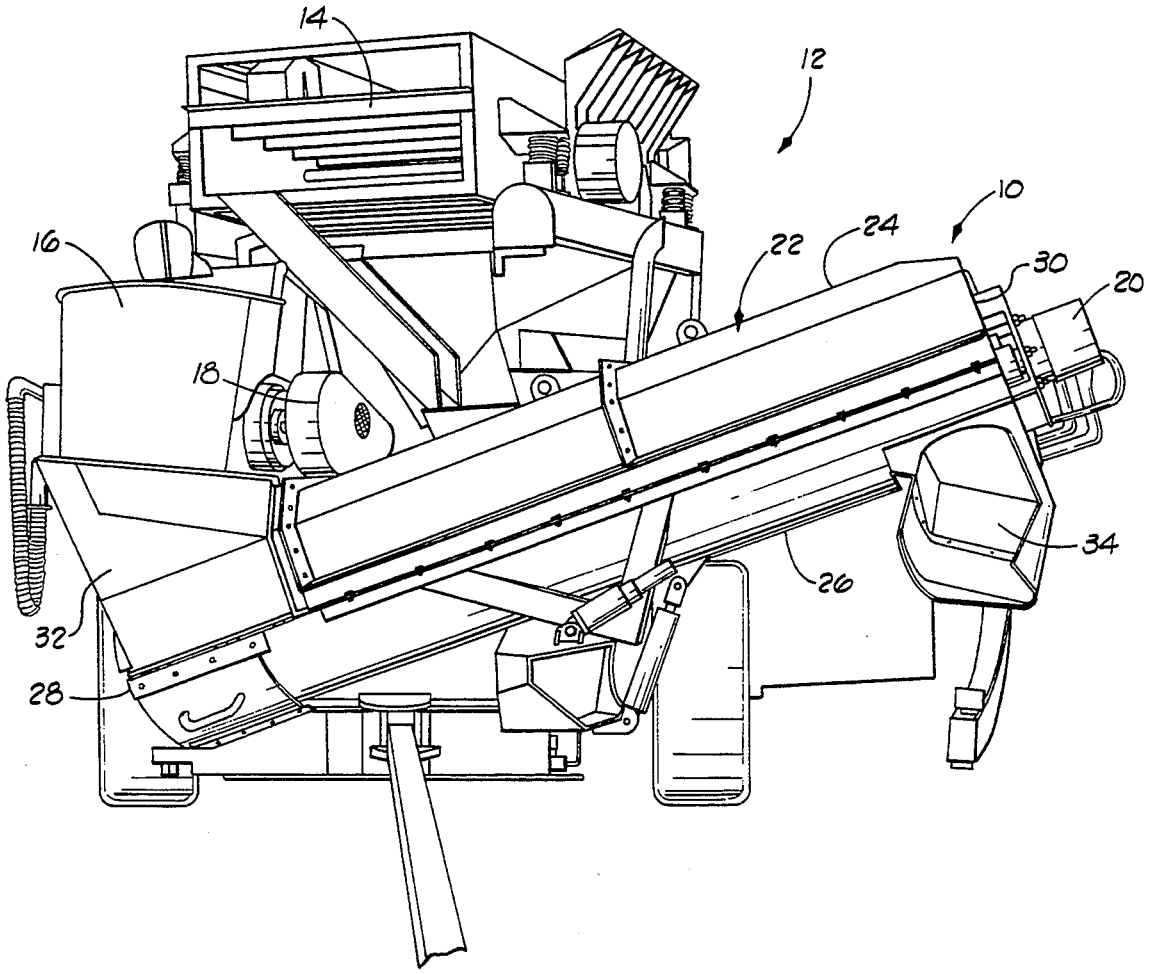
FIG. 1 is a rear elevation of a mixer constructed in accordance with the present invention and attached to a vehicle.

Referring to the drawings in general, and to FIG. 1 in particular, shown therein and designated by the general reference numeral 10 is a mixer constructed in accordance with the present invention and attached to a mixer vehicle 12.

Although the mixer 10 may be utilized in a wide variety of ways, it is typically attached to a mixer vehicle 12, as shown in FIG. 1. In a common application, the mixer vehicle 12 is operated in conjunction with and in front of a milling machine (not shown) for in-place recycling of asphalt pavement. The milling machine is used to remove asphalt ("recycle aggregate") from a road surface and the recycle aggregate is conveyed to a screen 14 on the mixer vehicle 12.

The screen 14 allows recycle aggregate smaller than a predetermined size to pass to a storage bin 16 and belt conveyor 18 which feeds recycle aggregate into the mixer 10. Recycle aggregate which is larger than the predetermined size is routed from the screen 14 to a crusher (not shown) mounted to the mixer vehicle 12. The crusher breaks the oversized recycle aggregate into smaller pieces. The crushed recycle aggregate is then dropped to the road surface to be picked up by the milling machine for a second pass to the mixer vehicle 12. The crushed recycle aggregate should be small enough to pass through the screen 14 to the mixer 10 on its second pass.

The mixer vehicle 12 includes a reservoir of bituminous liquid and a conduit extending from the reservoir to the mixer 10 for supplying bituminous liquid into the mixer 10. The mixer vehicle 12 also includes a conventional hydraulic system for driving a hydraulic motor 20 for the mixer 10 and other hydraulic components of the mixer vehicle 12. For example, suitable electro-hydraulic controls are provided to regulate the amounts of bituminous liquid and recycle aggregate being supplied to the mixer 10.

The mixer 10 includes an elongated housing 22 having an upper wall 24, a lower wall 26, an inlet end 28 and a discharge end 30. A feed chute 32 communicates into the housing 22 through the upper wall 24 at the inlet end 28 of the housing 22 for the introduction of recycle aggregate into the housing 22. A discharge chute 34 extends from the lower portion of the discharge end 30 of the housing 22 for removal of recycle asphalt mix. The finished asphalt mix is typically conveyed from the discharge chute 34 of the mixer 10 to the rear of the milling machine to be laid down as a new road surface.

Figure 2:
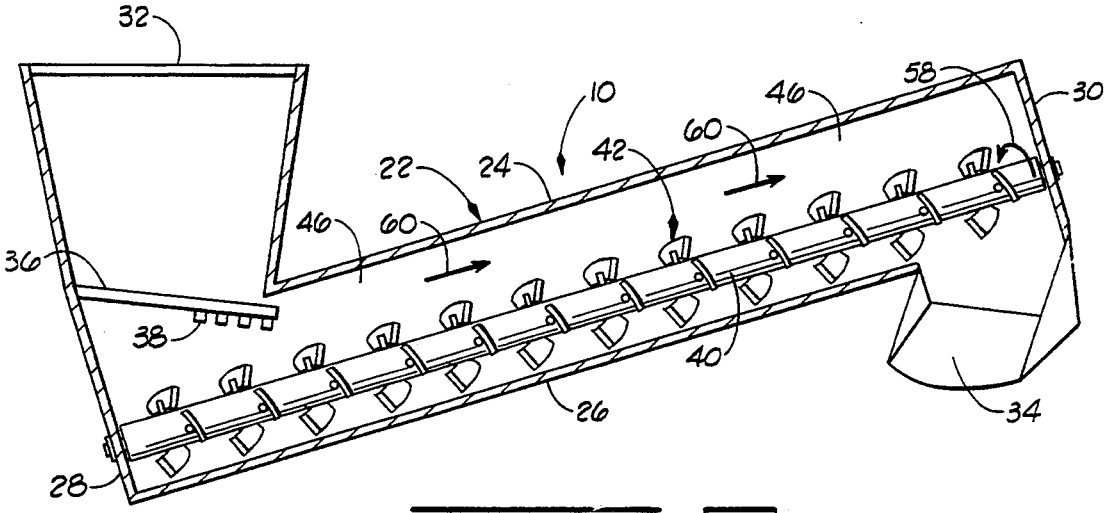
FIG. 2 is a partly diagrammatical, sectional side view of the mixer of FIG. 1.

As illustrated by FIG. 2, the mixer 10 has an injection tube 36 which extends into the housing 22 near the inlet end 28 of the housing 22. The injection tube 36 includes a plurality of nozzles which are adapted to spray bituminous liquid into the housing 22. One of the nozzles is designated by reference numeral 38 and is generally representative of the nozzles of the injection tube 36. The injection tube 36 is connected to the conduit of bituminous liquid from the reservoir in order to receive a supply of bituminous liquid.

The mixer 10 further comprises a rotatable shaft 40, which extends from the inlet end 28 to the discharge end 30 of the mixer housing 22. The hydraulic motor 20 shown in FIG. 1 is attached to the shaft 40 and drives the rotation of the shaft 40.

The mixer 10 further includes a plurality of blades, which are rigidly attached to the shaft 40. One of the blades is designated by reference numeral 42 and is generally representative of the blades of the mixer 10. Each blade 42 is connected to the shaft 40 with a mounting post to space the attached blade 42 a distance from the shaft 40. One of the mounting posts is designated by reference number 44 and is representative of the mounting posts in general. The blades 42, mounting posts 44, and the shaft 40 are typically welded together, but may be connected by bolts or any other suitable arrangement.

The outer edge of the blades 42 and the inner lower wall 26 of the housing 22 are curved to fit one another and the blades 42 are positioned to rotate into near contact with the inner lower wall 26 of the housing 22. The upper wall 24 of the housing 22, however, is spaced a distance from the blades 42 to define an open slinging area 46 above the blades 42.

Figure 3:
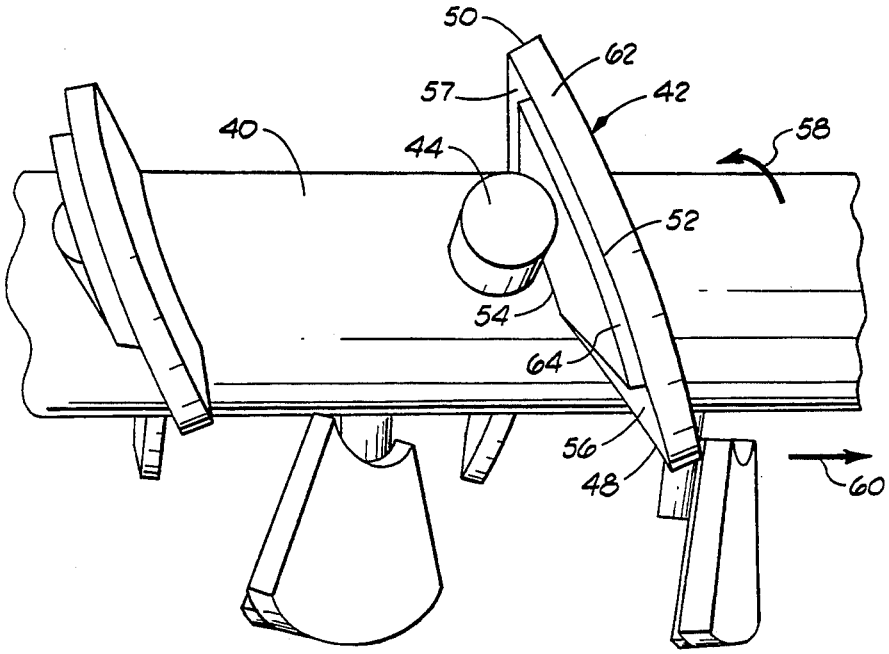
FIG. 3 is a side elevation of a portion of the rotatable shaft of the mixer of FIG. 2.

As shown most clearly in FIG. 3, the mounting posts 44 extend from the shaft 40 and the blades 42 are arranged in spaced relationship along the length of the shaft 40. In a preferred embodiment, the blades 42 are uniformly spaced along the length of the shaft 40. The positioning of the blades 42 defines a helical pattern. In other words, if the sides of adjacent blades were extended to connect with one another, an unbroken helix extending over the length of the shaft 40 would be formed by the blades 42.

Figure 4:
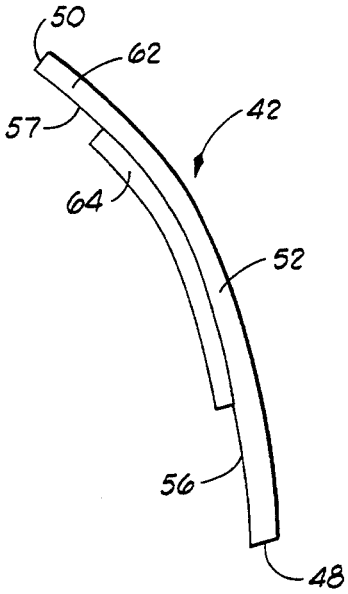
FIG. 4 is a top plan view of one of the blades of the mixer of FIG. 2.
Figure 5:
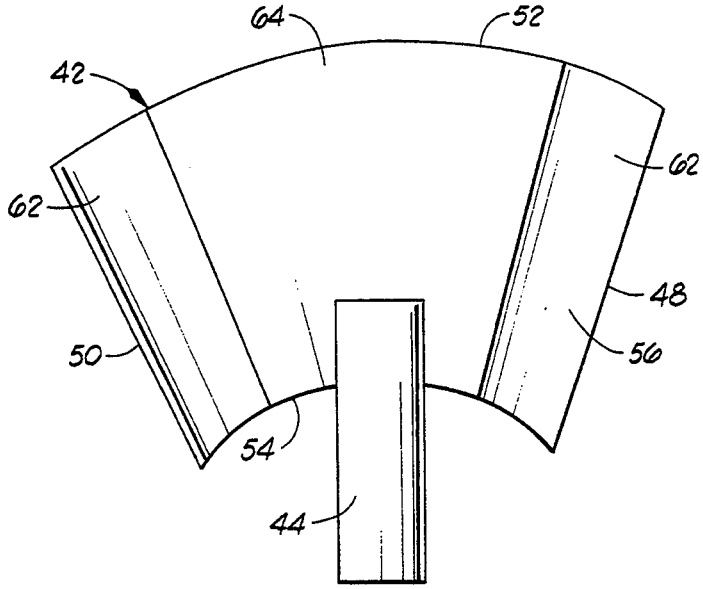
FIG. 5 is an end view of one of the blades and mounting post of the mixer.

As best illustrated by FIGS. 4 and 5, each blade 42 is basically a curved or arched plate with opposite sides 48 and 50, a curved or convex outer end 52 and an arcuate or concave inner end 54. At least one side 50, and typically each side 48 and 50, has an outer portion which is thinner than the rest of the blade 42. Typically, the reduced thickness areas 56 and 57 of the sides 48 and 50, respectively, are approximately one-half the thickness of the remainder of the blade 42.

The area 57 of side 50 is a leading reduced thickness area which leads the blade 42 into the material as the blade 42 is rotated in direction 58. The leading side 50 may also have a beveled edge (not shown).

In accordance with this design, each blade 42 may be constructed by joining a wider curved plate 62 and a narrower curved plate 64 in a nested or face-to-face relationship. The two plates 62 and 64 should be substantially the same height and thickness and may be attached to one another by welding, bolting or in any other suitable manner.

Operation

As shown in FIG. 1, the mixer 10 is attached to the mixer vehicle 12 with the inlet end 28 of housing 22 at a lower elevation than the discharge end 30 of the housing 22. This slope of the housing 22 forces the recycle aggregate and bituminous liquid ("material") to travel uphill from the inlet end 28 to the discharge end 30 of the housing 22. In this manner, the material is retained within the housing 22 long enough to produce a thorough mixing of the material.

The operation of the mixer 10 is best understood with reference to FIG. 2. Recycle aggregate is introduced into the mixer housing 22 through the inlet chute 32 and bituminous liquid is sprayed into the housing 22 from the nozzles 38 of the injection tube 36. The shaft 40 is rotated in the direction indicated by direction arrow 58 to mix and convey the material from the inlet end 28 of the mixer 10 to the discharge chute 34. Direction arrows 60 indicate the direction in which the material flows through the housing 22.

As the shaft 40 is rotated, the blades 42 pick up the material toward the lower wall 26 in the housing 22 and sling the material into the slinging area 46 above the blades 42. The material hits the inner upper wall 24 and falls back down toward the lower wall 24 of the housing 22. As shown most clearly in FIG. 3, the reduced thickness area 56 of the side 50 of each blade 42 allows the blade 42 to part the material more easily.

Simultaneous with the mixing action, the helical pattern of the blades 42 urges the material up the slope from the inlet end 28 toward the discharge end 30 of the housing 22 as indicated by direction arrows 60. Eventually the mixed material reaches the discharge chute 34 and the asphalt mix is removed from the mixer 10.

The mixer 10 is described hereinabove for use in mixing bituminous liquid and recycle aggregate to produce asphalt mix. The mixer 10 may be utilized to mix virtually any liquids, solids or combinations thereof. For example, the mixer 10 may be employed to mix water, cement, sand and aggregate to produce a concrete mix.

Changes may be made in the combinations, operations and arrangements of the various parts and elements described herein without departing from the spirit and scope of the invention as defined in the following claims.

What is claimed is:

1. A mixer comprising:

an elongated housing having an inlet end, a discharge end, an upper wall and a lower wall;

a rotatable shaft extending from the inlet end to the discharge end of said housing;

a plurality of blades mounted to said shaft to extend radially from said shaft at a uniform distance from said shaft, said blades being spaced apart along the length of said shaft to outline a uniform, helical path around said shaft, each one of said blades having a convex outer end, a concave inner end and substantially straight sides, each one of said blades also being arched from side to side;

inlet means for introducing material into said housing;

means for introducing liquid into said housing; and discharge means for removing material from the discharge end of said housing;

wherein said blades are positioned such that the outer ends of said blades travel across the lower wall of said housing with slight clearance as said shaft is rotated.

2. The mixer of claim 1 wherein the upper wall of said housing is spaced a distance from said blades to define a slinging area between said blades and the upper wall of said housing.

3. The mixer of claim 1 wherein said blades are uniform in size and shape.

4. The mixer of claim 1 further comprising:

means for inclining said housing with the discharge end at a higher elevation than the inlet end.

5. The mixer of claim 1 further comprising:

a plurality of mounting posts, each mounting post corresponding to one of said blades, wherein each mounting post rigidly connects the corresponding one of said blades to said shaft and spaces the corresponding one of said blades a distance from said shaft.

6. The mixer of claim 1 wherein said inlet means introduces material into said housing through the upper wall of said housing.

7. The mixer of claim 1 wherein said discharge means removes material from said housing through the lower wall of said housing.

8. The mixer of claim 1 wherein each blade has a leading area of reduced thickness parting into the material as the blade is rotated.

9. The mixer of claim 8 wherein each blade has a trailing area of reduced thickness to balance the weight of each blade on the rotatable shaft.

10. A mixer comprising:

an elongated housing having an inlet end, a discharge end, an upper wall and a lower wall;

a rotatable shaft extending from the inlet end to the discharge end of said housing;

a plurality of posts rigidly attached to said shaft, said posts extending radially from said shaft and being uniformly spaced apart to track a helical path around said shaft for the length of said shaft;

a plurality of blades, each blade being rigidly attached to a corresponding one of said posts to be supported at a distance from said shaft and to outline a uniform, helical shape around said shaft, each one of said blades having a convex outer end, a concave inner end and substantially straight sides, each one of said blades also being arched from side to side;

inlet means for introducing material into said housing;

means for introducing liquid into said housing; and discharge means for removing material from the discharge end of said housing.

11. The mixer of claim 10 wherein the upper wall of said housing is spaced a distance from said blades to define a slinging area between said blades and the upper wall of said housing.

12. The mixer of claim 10 further comprising:

means for inclining said housing with the discharge end at a higher elevation than the inlet end.

13. The mixer of claim 10 wherein said inlet means introduces material into said housing through the upper wall of said housing.

14. The mixer of claim 10 wherein said discharge means removes material from said housing through the lower wall of said housing.

15. The mixer of claim 10 wherein each blade has a leading area of reduced thickness parting into the material as the blade is rotated.

16. The mixer of claim 15 wherein each blade has a trailing area of reduced thickness to balance the weight of each blade on said shaft.

17. The mixer of claim 10 wherein said blades are positioned such that the outer ends of said blades travel across the lower wall of said housing with slight clearance as said shaft is rotated.

18. A mixer comprising:

an elongated housing having an inlet end, a discharge end, an upper wall and a lower wall;

a rotatable shaft extending from the inlet end to the discharge end of said housing;

a plurality of blades mounted to said shaft to extend radially from said shaft at a uniform distance from said shaft, said blades being spaced apart along the length of said shaft to outline a uniform, helical path around said shaft, each one of said blades having a convex outer end, a concave inner end and substantially straight sides, each one of said blades also being arched from side to side;

inlet means for introducing material into said housing;

means for introducing liquid into said housing; and discharge means for removing material from the discharge end of said housing.

19. The mixer of claim 18 wherein the upper wall of said housing is spaced a distance from said blades to define a slinging area between said blades and the upper wall of said housing.

20. The mixer of claim 18 wherein said blades are uniform in size and shape.

* * * * *